United States Patent [19]

Laird

[11] Patent Number: 4,844,541

[45] Date of Patent: Jul. 4, 1989

[54] ROCKING FURNITURE WITH REMOVABLY SECURED AND ADJUSTABLE CUSHIONS

[76] Inventor: William B. Laird, c/o Blockhouse Company, Inc., 121 First Ave., Red Lion, Pa. 17351

[21] Appl. No.: 99,187

[22] Filed: Sep. 21, 1987

[51] Int. Cl.[4] ..... A47C 3/025; A47C 4/02

[52] U.S. Cl. ..... 297/302; 248/603; 248/618; 297/232; 297/265; 297/325; 297/440; 297/445

[58] Field of Search ..... 297/261, 264, 265, 267, 297/300, 301, 302, 440, 442, 443, 444, 258, 232, 325, 326; 248/560, 580, 582, 596, 603, 618-620

[56] References Cited

U.S. PATENT DOCUMENTS

| | | | |
|---|---|---|---|
| D. 263,656 | 4/1982 | Williams . | |
| 421,045 | 2/1890 | Caldwell | 297/303 |
| 1,631,081 | 5/1927 | Bennett . | |
| 1,696,126 | 12/1928 | Salmon | 297/300 |
| 2,673,353 | 3/1954 | Dean et al. . | |
| 2,783,717 | 3/1957 | Meldrum . | |
| 3,146,021 | 8/1964 | Ericson . | |
| 3,300,244 | 1/1967 | Hughes | 297/261 X |
| 3,371,958 | 3/1968 | Caldemeyer et al. | 297/267 X |
| 3,462,190 | 8/1969 | Campbell | 297/265 X |
| 3,972,565 | 8/1976 | Smith . | |
| 3,989,300 | 11/1976 | Heumann . | |
| 4,025,020 | 5/1977 | Goff et al. | 297/303 X |
| 4,138,949 | 2/1979 | Gutridge et al. . | |
| 4,285,544 | 8/1981 | Zapf . | |
| 4,395,071 | 7/1983 | Laird | 297/440 |
| 4,488,755 | 12/1984 | Nemschoft | 297/283 X |
| 4,492,409 | 1/1985 | Laird | 297/440 |
| 4,662,682 | 5/1987 | Maurel | 297/353 |

FOREIGN PATENT DOCUMENTS

| | | |
|---|---|---|
| 178298 | 9/1953 | Austria . |
| 1283660 | 12/1961 | France . |
| 1279416 | 6/1972 | United Kingdom . |

*Primary Examiner*—Peter R. Brown

*Attorney, Agent, or Firm*—Panitch Schwarze Jacobs & Nadel

[57] ABSTRACT

The disclosure pertains to furniture of the chair, loveseat and couch type which includes a frame, first and second members linked with one another and generally parallel to one another, one or more spring members coupling the first and second members with the frame and permitting partial rotation of the first and second members about an axis perpendicular to the first and second members and biasing the members back to an initial orientation when rotated, a cushion received by and supported by the first pair of members, a latch mechanism within the cushion for latching the cushion to at least one of the first and second members receiving the cushion, a mating element on at least one of the members for engaging with the latch and an actuator within the cushion coupled with the latch for disengaging the latch mechanism from the mating element of the members.

18 Claims, 3 Drawing Sheets

ROCKING FURNITURE WITH REMOVABLY SECURED AND ADJUSTABLE CUSHIONS

This application is a related to my U.S. patent application entitled "Furniture with Removably Secured and Adjustable Cushions" which is filed contemporaneously herewith and is incorporated by reference in its entirety herein.

FIELD OF THE INVENTION

This invention relates to furniture having removably securable cushions and, in particular, to such furniture in which rocking capability is provided with cushions which are adjustable in position.

BACKGROUND

A conventional chair has a seat cushion and a back cushion. A loveseat generally has two seat cushions and two back cushions. A couch generally has three or more seat cushions and three or more back cushions.

There is a need for furniture that has cushions which are adapted to be removed so that they may be turned over and/or replaced while being securable to the furniture frame in a manner so that only authorized persons may remove the cushions. Furniture of this type is described in U.S. Pat. Nos. 4,395,071 and 4,492,409.

To increase the enjoyment of such furniture, it would be desirable to provide such furniture with a rocking mechanism. However, a rocking mechanism must be designed in order that the cushions may still be removably secured to the frame for enjoyment of that beneficial aspects of the furniture.

Because of their different average sizes, men and women have different optimal seating dimensions. Furniture cushions are generally sized and positioned to generally equate the comfort provided to both men and women so that both potential markets are served. As a result, the seating comfort of no individual potential class of users or individual user is optimized. Therefore, it is further desirable that cushion position on such furniture be adjustable so that the furniture might be customized for the comfort of an individual user or for one potential class of users.

SUMMARY OF THE INVENTION

The present invention is directed to furniture of the chair, loveseat and couch type. The furniture includes a frame and first and second rails. Each rail is generally L-shaped and has first and second intersecting and generally transverse arms. Linkage means is provided for securing the first and second rails together, the first arms of the first and second rails being generally parallel to one another and the second arms of the first and second rails being generally parallel to one another. First spring means are provided for supporting the first and second rails from the frame in an initial orientation with the first arms generally horizontally disposed and the second arms generally vertically disposed. The first spring means permits partial rotation of the first and second rails about an axis generally perpendicular to the first and second arms of the first and second rails and biases the first and second rails back to the initial orientation after the rails are rotated. A first seat cushion is received by and supported by the first arms. A first back cushion is received by and supported by the second arms. At least one of the first seat and first back cushions includes latch means within the one cushion for latching the one cushion with at least one of the arms receiving and supporting the one cushion. The one arm includes mating means for engaging with the latch means. The one cushion further includes actuator means coupled with the latch means for disengaging the latch means from the mating means to permit removal of the one cushion from the receiving arms.

BRIEF DESCRIPTION OF THE DRAWINGS

The foregoing summary, as well as the following detailed description, will be better understood when read in conjunction with the appended drawings. For the purpose of illustrating the invention, there is shown in the drawings, an embodiment which is presently preferred. However, it is understood that this invention is not limited to the precise arrangements and instrumentality shown. In the drawings.

DETAILED DESCRIPTION IN THE INVENTION

Figure 1:
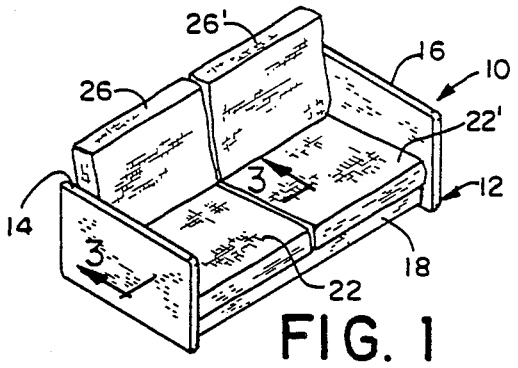
FIG. 1 is a perspective view of furniture in accordance with the present invention in one possible configuration.

In the drawings, like numerals (primed and unprimed) indicate like or identical elements throughout.

There is shown in FIG. 1 a furniture piece in accordance with the present invention, indicated by numeral 10, in one of its several possible configurations. Furniture 10 of the present embodiment is in the form of a loveseat. However, one of ordinary skill will appreciate that the components of the disclosed loveseat can easily be used to construct both chair and couch-type furniture pieces.

Figure 2:
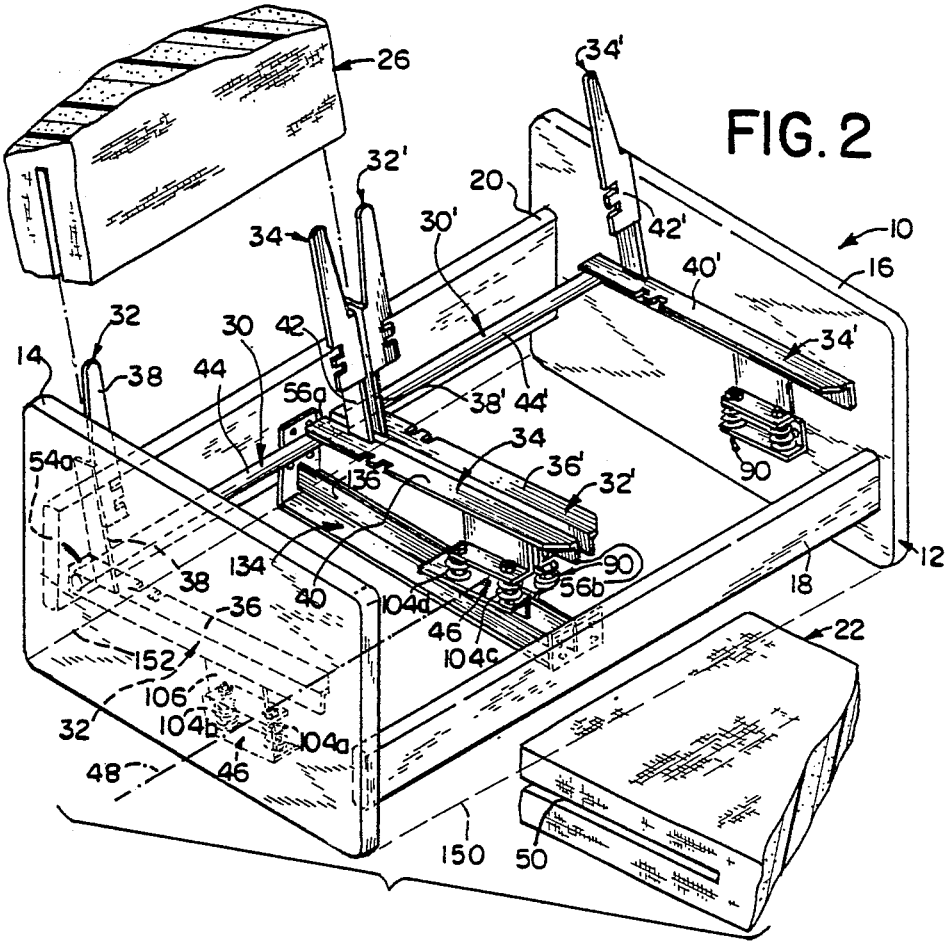
FIG. 2 is an enlarged, partially exploded and partially sectioned perspective view of portions of the furniture shown FIG. 1.

The furniture piece 10 includes a frame 12 with substantially mirror-image frame side members 14 and 16 secured together with a frame front member 18 and frame rear member 20 (see FIG. 2). The furniture 10 includes two seat cushions 22 and 22' and two back cushions 26 and 26' disposed on the frame 12. Each of the cushions 22, 22', 26, 26' provides a generally rectangular support surface. The generally rectangular support surfaces of the two seat cushions 22 and 22' are generally parallel to one another while the rectangular support surfaces of the back cushions 26 and 26' are substantially parallel to one another and substantially transverse to the support surfaces of the seat cushions 22 and 22'.

Referring to FIG. 2, first seat cushion 22 and first back cushion 26 are received upon and supported by a first seating unit frame 30. A second identical seating unit frame 30' is provided adjoining one side of the first seating unit frame 30 and receives and supports the second seat cushion 22' and second back cushion 26'. Since the seating unit frames 30 and 30' are identical, only the first seating unit frame 30 will be further described.

The first seating unit frame 30 includes first and second rails 32 and 34 respectively. The rails 32 and 34 are mirror images of one another. Each rail 32, 34 is generally L-shaped. The first rail 32 includes first and second intersecting and generally transverse arms 36 and 38.

The second rail includes mirror-image, intersecting and generally transverse first and second arms 40 and 42, respectively. The first and second rails 32, 34 are secured together by linkage means provided in the form of a hollow tube 44 extending between the first and second rails 32, 34 and secured with each of the rails by suitable means such as welding. The rails 32 and 34 are secured together by the tube 44 in an initial orientation with the first arms 36 and 40 of the first and second rails 32 and 34, respectively, generally parallel to one another and the second arms 34 and 38 of the first and second rails 32 and 34, respectively, generally parallel to one another.

First spring means, indicated generally by reference numeral 46, is provided for supporting the secured first and second rails 32 and 34 from the frame 12 in an initial orientation with the first arms 36 and 40 generally horizontally disposed and the second arms 38 and 42 generally vertically disposed. The first spring means 46 permits partial rotation of the secured first and second rails 32, 34 about an axis 48 extending generally through the spring means 46, for example, when someone sits on the first seat cushion 22 leaning back against the first back cushion 26. The axis 48 is generally perpendicular to the first and second arms 36, 40 and 38, 42 of the first and second rails 32 and 34. The spring means 46 further biases the first and second rails 32 and 34 back to the initial orientation depicted in FIG. 2 after being rotated, for example, after someone sitting back on the first seat and back cushions 22 and 26 stands up from those cushions.

The hollow tube 44 further acts as torsion means for biasing the first arms 36 and 40 to remain generally parallel and the second arms 38 and 42 to remain generally parallel to prevent twisting of the first and second rails 32 and 34. The torsional effect is important as the pairs of first and second arms must be kept parallel to permit movement of the supported cushions 22 and 26 without binding, a problem not important in other types of rocker furniture.

Figure 3:
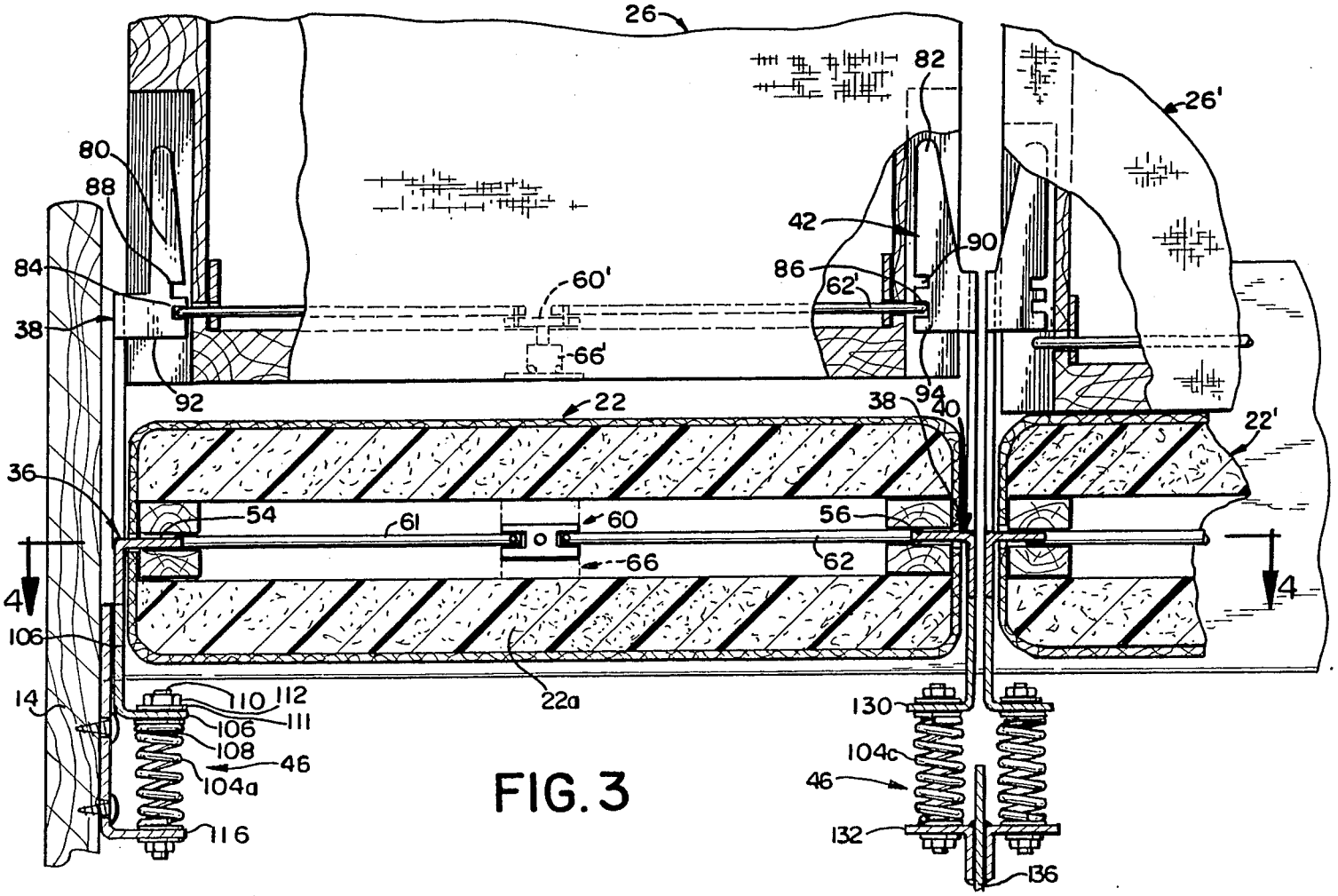
FIG. 3 is a localized sectioned, front elevation view of a portion of the furniture of FIG. 1 taken along the lines 3—3 in FIG. 1, but on an enlarged scale.
Figure 4:
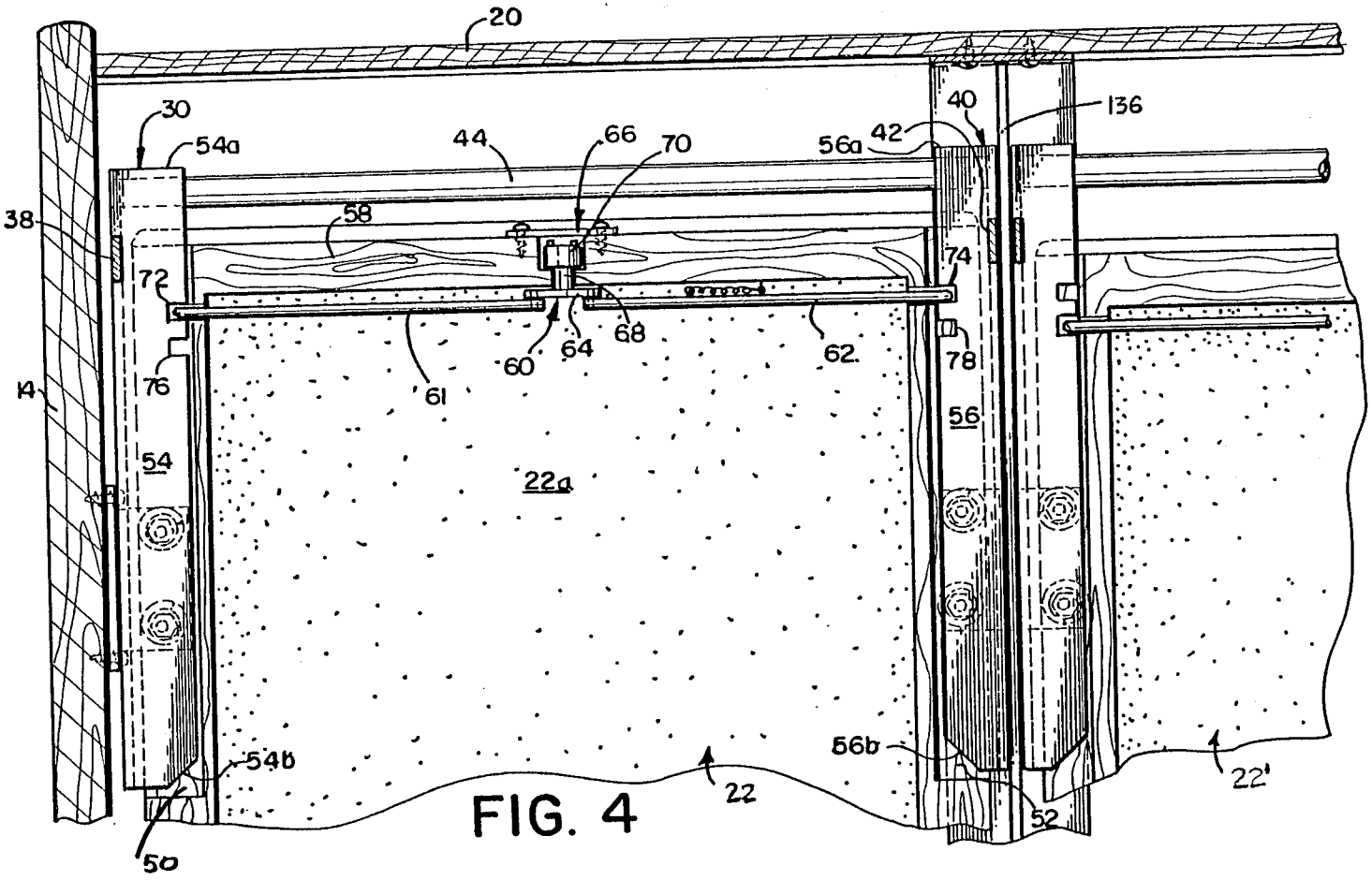
FIG. 4 is a localized sectioned, top view taken along the lines 4—4 of FIG. 3.

As is seen to varying degrees in FIGS. 2–4, first seat cushion 22 is received by and supported by first arms 36 and 40 while first back cushion 26 is received by and supported by second arms 38 and 42, respectively. Each of the depicted first arms 36 and 40 is preferably formed by suitably cutting an L-shaped angle member but other conventional metal fabrication techniques might be employed. A generally horizontally disposed flange portion of each angle member forming first arms 36 and 40 constitutes a separate one of a first pair of generally parallel and elongated tongue members 54 and 56, respectively (FIGS. 3 and 4). The hollow tube 44 is secured to and secures together the horizontal flange portion of each of the first arms 36 and 40 also forming the tongue members 54 and 56, respectively, of each arm. The hollow tube 44 further acts as a torsion member biasing the tongue members 54 and 56 parallel to one another with respect to their elongated dimension and preventing rotation of the arms 36 and 40 around their elongated dimension (i.e. axes perpendicular to axis 48) further keeping the planar flange portions forming the tongue members 54 and 56 coplanar.

As may be seen to varying degrees in FIGS. 2 through 4, the first seat cushion 22 includes a pair of spaced openings in the form of a pair of grooves 50 and 52 on opposing sides of the first seat cushion. Each of the first pair of tongue members 54 and 56 extends into and is received by a separate one of the grooves 50 and 52, respectively.

Referring to FIGS. 3 and 4 where sectioned portions of the first seat cushion 22 are depicted, the first seat cushion 22 includes internal latch means, indicated generally by reference numeral 60, for latching the seat cushion 22 with at least one of the first arms 36 and 40 receiving and supporting the first seat cushion 22. In the embodiment depicted, the internal latch means 60 latches the first seat cushion 22 with each of the tongue members 54 and 56 of each of the first arms 36 and 40, respectively. The latch means 60 includes a pair of latch members in the form of rods 61 and 62 in the present embodiment, each pivotally connected at adjoining ends to a generally rectangular link member 64. An actuator means within the first seat cushion 22, indicated generally by reference numeral 66, is coupled with the internal latch means 60. The actuator means 66 includes a shaft 68 coupling the rectangular link member 64 with a rotatable member 70. The rotatable member 70 is counter-sunk in a hole formed in a portion of a generally rectangular, hollow, internal frame 58 of the first seat cushion 22 at a "rear" end of that cushion proximal the frame rear member 20. The rotatable member 70 receives a keyed tool which is used to rotate the member 70 and the coupled rectangular link member 64 As is indicated in FIG. 4, biasing means such as a tension coil spring 71 is secured between one latch member rod 61 and the frame 58 to outwardly bias the rods 61, 62.

As is best seen in FIG. 4, the tongue member 54, 56 of each first arm 36, 40, respectively, includes mating means for engaging with the latch means 60 in the form of a first notch 72 and 74, respectively. Each notch 72 and 74 receives and engages by interference fit, one of the latch members 61 and 62, respectively, preventing removal or movement of the first seat cushion 22 along the first arms 36 and 40 or their tongue members 54 and 56. In order to adjust the locking location of the first seat cushion 22 along the first arms 36 and 40, each of the tongue members 54 and 56 is provided with a second mating means in the form of a second notch 76 and 78, respectively, for engaging with the internal latch means 60 latch member rods 61 and 62, respectively, at a second position spaced from the first notch position along the first arms 36 and 40. The rotation of the rotatable member 70 of the actuator means 66 disengages the rods 61 and 62 from engaged mating means 72 and 74 or 76 and 78 permitting removal of the first seat cushion 22 from the receiving arms 36 and 40 and/or readjustment of the position of that seat cushion along those arms.

As can be seen in FIG. 3 the first back cushion 26 is provided with identical internal latch means 60' for latching the cushion 26 with mating means in the form of notches 84 and 86 provided in tongue members 80 and 82, respectively, forming portions of the second arms 38 and 42, respectively. As was the case with the tongue members of the first arm 36 and 40, the tongue members 80 and 82 of the second arms 38 and 42, respectively, are each provided with additional mating means in the forms of second notches 88 and 90, respectively, spaced from the first notches 84 and 86, respectively. In addition, a lower shoulder 92 and 94 of each tongue member 80 and 82 constitutes yet another mating means for engaging with the latch member rods 61' and 62' providing three possible adjustment heights for the back cushion 26. The second seat cushion 22' and second back cushion 26' include identical internal latch and actuator mechanisms, portions of which can be seen in FIG. 3. The internal latch mechanism, coupled actuator and keyed actuator tool are described in one or both of U.S. Pat. Nos. 4,395,071 and 4,492,409, both of which are incorporated by reference in their entirety. The provision of multiple mating means in the tongue members is the subject of copending patent application entitled "Furniture With Removably Secured and Adjustable Cushions" filed with this application and incorporated by reference herein.

FIG. 3 illustrates two of the three separate positions at which the back cushions 26 and 26' may be engaged (intermediate and lower positions, respectively) with the tongue members 80 and 82. FIG. 4 illustrates each of the two separate positions at which the seat cushions 22 and 22' may be engaged (recessed and protruding, respectively) with receiving and supporting tongue members.

The loveseat pieces of furniture 10 depicted include a second identical rocker seating unit operating independently of the first rocker seating unit. As best seen in FIG. 2, the second rocker seating unit also includes a second seating unit frame 30', identical to frame 30, formed by third and fourth rails 32' and 34', identical to the first and second rails 32 and 34, respectively. Again, each of the third and fourth rails 32' and 34' is generally L-shaped and has first and second intersecting and generally transverse arms 36', 38' and 40', 42', respectively. Linkage means is again provided in the form of a hollow tube 44' securing third and fourth rails 32' and 34' together with the first arms 36' and 40' generally parallel to one another and the second arms 38' and 42' generally parallel to one another. Second spring means 90, which is a mirror of the first spring means 46, is provided for supporting the third and fourth rails from the frame 12 in an initial orientation with the first arms 36' and 40' generally parallel with the first arms 36 and 40 of the first and second rails and the second arms 38' and 42' generally parallel with the second arms 38 and 42 of the first and second rails. Again, the second spring means 90 permits partial rotation of the third and fourth rails from the indicated initial orientation about the same axis 48, which is generally perpendicular to the first and second arms 36', 38', 40' and 42', and biases the third and fourth rails 32' and 34' back to the indicated initial orientation. The second seat cushion 22' is received and supported by the first arms 36' and 40' while the second back cushion 26' is received and supported by the second arms 38' and 42'. As previously indicated, each of the second seat and back cushions 22' and 26' includes latch means (partially seen in FIGS. 3 and 4) within the cushion for latching the cushion with at least one arm of the third and fourth rails receiving and supporting the one cushion. Again, each of the first and second arms 36', 40' and 38', 42' of the third and fourth rails include mating means in the form of notches or notches and a lower shoulder for engaging with the cushion latch means. An actuator in each cushion 22' and 26' is coupled with the latch means in those cushions for disengaging the latch means from the mating means.

As is best seen in FIG. 2, the spring means 46 includes separate pairs of substantially identical coil springs **104*a*–104*d*. A first pair of the springs 104*a* and 104*b* is located beneath the first arm 36 while a second pair 104*c* and 104*d* is located beneath the first arm 40. As is best seen in FIG. 3, the first arm 36, including its tongue member 54, is coupled with a coil spring 104*a* of the first pair through another L-shaped spacer member 106, a vertical flange portion of which is coupled by suitable means such as welding (depicted in FIG. 3) or bolting (not depicted) with the downward-extending flange portion of the angle iron forming the first arm 36. An upper end of each of the coil springs 104 is secured to the lower surface of the horizontal flange portion of the L-shaped spacer member 106 by means of a washer 108 receiving a nut 110 secured to the horizontal flange by means of a lock washer 111 and bolt 112. The washer 108 is passed between the outermost coil at the upper end of the spring 104*a* and the next adjoining coil and is configured to seat on the outermost coil. An L-shaped mounting bracket 116 has a vertical flange portion secured to the frame side member 14 by suitable means such as wood screws 118 (depicted) or nuts and bolts (not shown). The lower end of the coil spring 104*a* is secured to the upper surface of the horizontal flange portion of the second L-shaped mounting bracket 116 by a similar washer, nut, lock washer and bolt arrangement. The coupling of the second spring 104*b* of the first pair, behind the depicted first spring 104*a*** of that pair, is identical.

On the opposing side of the seat cushion 22, a second L-shaped spacer member 130, a mirror image of first spacer member 106, has a vertical flange portion likewise attached to the descending vertical flange portion of the first arm 40 by welding or other suitable means. Spacer member 130 includes a horizontal flange portion with a lower surface to which a coil spring **104*c* of the second pair is again coupled by a washer, nut, lock washer and bolt arrangement identical to washer 108, nut 110, lock washer 111 and bolt 112. An upper surface of a horizontal flange portion of a second L-shaped mounting bracket 132 is coupled with the remaining lower end of the coil spring 104*c* of the second pair 102. Again, the remaining spring 104*d* is coupled between member 130 and bracket 132 in a manner identical to spring 104*c***.

As is best seen in FIG. 2, the frame 12 is provided with a central support bracket 134 extending between and secured to the interior vertical sides of the frame front and rear members 18 and 20, respectively. The central support bracket 134 has an essentially inverted T-shape in cross section with a horizontal flange portion and a central flange portion 136 extending generally vertically upwardly from the horizontal flange portion and seen in FIGS. 3 and 4. The vertical flange portion of the second, L-shaped bracket 132 is coupled to the central flange portion 136 by suitable means such as welding as indicated in FIG. 3. The first and second L-shaped spacer members 106 and 130 elevate their associated tongue members 54 and 56, respectively, above the pairs 100 and 102 of coil spring members 104 to permit a lower portion **22*a* (FIGS. 3 and 4) of the first seat cushion 22 to extend between the tongue members 54 and 56 and their associated pairs 100, 102 of supporting coil spring members 104**.

Referring to FIG. 4, each of the horizontal tongue members 54 and 56 has a "rear", end **54*a* and 56*a*, respectively, proximal a rear side of the frame represented by the frame rear member 20. Each tongue member 54 and 56 also has an opposing "front" end 54*b* and 56*b*, respectively, proximal the front side of the frame 12 represented by the frame front member 18 (see FIG. 2). As is best seen in FIG. 2, the front ends 54*b* and 56*b* of the first pair of tongue members 54 and 56 are supported above the rear ends 54*a* and 54*b*. This is to provide a rear-end downward cant to the seat cushion 22 for comfort and safety. It should further be noted that the spring means 46 is coupled between tongue members 54 and 56 and the frame 12 proximal the front ends 54*b* and 56*b* of tongue members. This is an important safety feature of the furniture, because someone seated on the seat and back cushions 22 and 26 would have a center of gravity rearwardly positioned from the axis of rotation 48 and the spring means 46. As a result, primary motion of the seating unit is down and inward into the frame 12** from the initial position and upward movement is back to the initial position. This manner of installation significantly lessens the likelihood of rotation of the rear ends of the first and second rails above the initial orientation, which might tend to throw or tip an individual seated on the furniture out of the furniture.

Yet another important safety feature of the disclosed construction is the location of the first and second rails 32 and 34 and spring means 46 entirely within an area footprint defined by the frame 12. The frame side members 14 and 16 have bottom surfaces intended to contact and support the furniture on a floor. These bottom support surfaces of the frame side members 14 and 16 define points along a perimeter of an area footprint of the furniture 10. In the indicated furniture 10, if the lower surfaces of the frame side members 14 and 16 are in contact with the floor along the entire lower surface of the frame side members 14 and 16, the area footprint is formed by those lines of contact between the frame side members and the supporting floor and imaginary lines such as line 150 and 152 indicated in FIG. 2 connecting the ends of the support surfaces on the bottom of the frame side members 14 and 16. All of the rails 32, 34 and 32', 34' and the spring means 46 and 90 lie within the area footprint of the furniture 10 formed by the frame side members 14 and 16 and connecting imaginary lines 150 and 152.

One of ordinary skill in the art will be able to apply the principles of the invention disclosed with respect to the description of the preferred embodiment to other forms of furniture, namely chairs and couches. For a chair, a pair of rails connected by a linkage means may be supported directly from frame side members in the manner rails 32 and 34' are supported. A more complicated bottom support, like that employed to support central rails 34 and 32', may be employed in a chair but are not necessary. For a couch piece of furniture having three or more sets of seat and back cushions, both rails supporting intermediate seat and back cushion pairs may be supported from beneath in the manner in which rails 34 and 32' are supported.

One of ordinary skill in the art will also appreciate that other spring-supporting arrangements can be employed. These include but are not limited to a single vertically-oriented coil spring, like one of the pairs of vertically-oriented coil springs 104, supporting each rail; horizontally oriented torsional springs; or leaf springs.

Lastly, while loveseat-type furniture is described and couch-type furniture suggested in which the cushions directly adjoin one another, loveseat and couch-type furniture can be made by providing additional upright frame members extending front to back between adjoining seating units. These additional frame members would serve as arm rests and are preferred in pieces intended to be used with institutionalized individuals to prevent them from inserting their hands between the seating units where they might be injured.

It will be readily apparent to those skilled in the present art that various other modifications and embodiments of the furniture of the present invention can be constructed. All such modifications and variations that fall within the scope of the appended claims are intended to be covered by the present application.

I claim:

1. Furniture of the chair, loveseat and couch type comprising:

a floor-contacting stationary frame;

first and second rails, each of the first and second rails being generally L-shaped and having first and second intersecting and generally transverse arms;

torsional linkage means secured with each of the first and second rails for biasing the first arms of the first and second rails generally parallel to one another and the second arms of the first and second rails generally parallel to one another;

first spring means for supporting the first and second rails from the frame in an initial orientation with the first arms generally horizontally disposed and the second arms generally vertically disposed, the first spring means permitting partial rotation of the first and second rails on the frame about an axis generally perpendicular to the first and second arms of the first and second rails and biasing the first and second rails back to the initial orientation after being rotated, the first spring means comprises at least one spring coupled only the first rail with the frame and at least another spring coupling only the second rail with the frame;

a first seat cushion removably received by and supported by the first arms; and a first back cushion removably received by and supported by the second arms.

2. The furniture of claim 1, wherein the torsional linkage means is a hollow tube extending between the first and second rails and secured with each of the rails.

3. The furniture of claim 1 further comprising:

third and fourth rails, each of the third and fourth rails being generally L-shaped and having third and fourth intersecting and generally transverse arms;

linkage means securing the third and fourth rails together with the third arms generally parallel to one another and the fourth arms generally parallel to one another; and second spring means for supporting the third and fourth rails from the frame in an initial orientation with the third arms of the third and fourth rails generally parallel with the first arms of the first and second rails and the fourth arms of the third and fourth rails generally parallel with the second arms of the first and second rails, the second spring means permitting partial rotation of the third and fourth rails from the initial orientation about an axis generally perpendicular to the third and fourth arms of the third and fourth rails and for biasing the third and fourth rails back to the initial orientation when rotated from the initial orientation, independently of any rotation of the first and second rails;

a second seat cushion received and supported by the third arms of the third and fourth rails;

a second back cushion received and supported by the fourth arms of the third and fourth rails; and one of the second seat and back cushions received and supported by the arms of the third and fourth rails also including latch means within said one cushion for latching said one cushion with at least one arm of the third and fourth rails receiving and supporting said one cushion, said one arm including mating means for engaging the latch means, the latch means being disengageable from the mating means.

4. The furniture of claim 1 wherein the first arm of each of the first and second rails includes an end distal to the second arm of the same rail and wherein each spring of the first spring means couples a separate one each of the first and second rails to the frame through the first arms of each of the first and second rails proximate the distal end of each of the first arms.

5. The furniture of claim 1 wherein said first spring means are located such that the axis lies proximal ends of the first arms generally remote from the first back cushion.

6. The furniture of claim 1 wherein the first seat cushion internally receives at least a portion of each of the first arms and further comprising spacer means between the springs of the first spring means and each of the first arms for spacing the first arms from the springs sufficiently to permit portions of the first arms to be received from the first seat cushion.

7. The furniture of claim 1 wherein at least one of the first seat and first back cushions including latch means within the one cushion for latching the one cushion with at least one of the arms receiving and supporting the one cushion, the one arm including mating means for engaging said latch means, the latch means being disengageable from the mating means to permit removal of the one cushion from the receiving and supporting arms.

8. The furniture of claim 7 wherein the one arm receiving and supporting the one cushion includes at least two spaced mating means for engaging with the latch means of the one cushion at any one of at least two spaced positions along the one arm.

9. Furniture of the chair, loveseat and couch type comprising:

a floor-contacting, stationary frame;

a first pair of generally parallel and elongated tongue members;

torsional linkage means secured with each of the first pair of tongue members in a spaced relation of the tongue members for biasing the first pair of tongue members parallel to one another;

spring means coupled between each of the tongue members and the frame including at least one spring coupling only one of the tongue members with the frame and at least another spring coupling only the other tongue member to the frame for permitting partial rotation of the first pair of tongue members from an initial orientation around an axis generally perpendicular to the elongated direction of each tongue member and for biasing the tongue members back to the original orientation when rotated; and a first seat cushion having a pair of spaced openings, each opening receiving a separate one of the first pair of tongue members.

10. The furniture of claim 9 wherein the torsional linkage means comprises a hollow tube secured with each of the first pair of tongue members.

11. The furniture of claim 9 wherein the first cushion is a seat cushion wherein the frame has a front and rear side, wherein each of the first pair of tongue members has a front end proximal the front side of the frame and an opposing rear end proximal the rear side of the frame, and wherein each spring of the spring means is coupled between a separate one of the first pair of tongue members and the frame and only proximal the front end of the one tongue member.

12. The furniture of claim 11 wherein the spring means comprises four coil spring members, separate pairs of the four coil spring members coupling each of the first pair of tongue members with the frame.

13. The furniture of claim 12 further comprising spacer means between the four coil spring members and the first pair of tongue members for elevating the first pair of tongue members above the coil spring members to permit a portion of the first cushion to extend between the first pair of tongue members and the four coil spring members.

14. The furniture of claim 9 wherein the frame has at least one bottom surface for supporting the furniture on a floor surface, the at least one bottom surface defining a perimeter of an area footprint of the furniture and wherein the first and second rails and the spring means lie entirely within the area footprint.

15. The furniture of claim 9 wherein the spring means are located such that the axis lies proximal ends of each of the first pair of tongue members generally remote from the back cushion.

16. The furniture of claim 9 wherein the first seat cushion internally receives at least a portion of each of the tongue members and further comprising spacer means between the springs of the first spring means and each of the tongue members for spacing the tongue members from the spring sufficiently to permit portions of the tongue members to be received from the first seat cushion.

17. The furniture of claim 9 further comprising:

latch means within the first cushion for releasably latching the first seat cushion with at least one of the first pair of tongue members; and at least one of the first pair of tongue members including mating means for engaging with said latch means and securing the one cushion with the at least one tongue member.

18. The furniture of claim 17 wherein each of the first pair of tongue members includes at least two spaced mating means for engaging with the latch means of the first cushion at any one of at least two separate positions along the first pair of tongue members.

* * * * *